US005823487A

United States Patent [19]

Kirchhoff et al.

[11] Patent Number: 5,823,487

[45] Date of Patent: Oct. 20, 1998

[54] KEYBOARD SUPPORT ASSEMBLY

[75] Inventors: Kenneth J. Kirchhoff, Gem Lake; Robert J. Wolf, Woodbury, both of Minn.; James J. Frater, Middleton, Wis.; Manfred W. Suhr; Lawrence J. Fenske, both of Oregon, Wis.

[73] Assignee: Minnesota Mining and Manufacturing Company, Saint Paul, Minn.

[21] Appl. No.: 587,671

[22] Filed: Jan. 17, 1996

[51] Int. Cl.[6] ..... A47B 57/00

[52] U.S. Cl. ..... 248/118; 108/93; 248/284.1; 248/292.12; 248/918

[58] Field of Search ..... 248/118, 118.1, 248/118.3, 276.1, 284.1, 292.12, 286.1, 291.1; 108/93, 145

[56] References Cited

U.S. PATENT DOCUMENTS

| | | | |
|---|---|---|---|
| 473,919 | 5/1892 | Edsall | 248/292.12 |
| 1,815,411 | 7/1931 | Lewis | 248/292.12 |
| 2,982,285 | 5/1961 | Edwards . | |
| 3,778,125 | 12/1973 | Gutmann, Jr. et al. . | |
| 3,830,352 | 8/1974 | Kolpek . | |
| 4,183,489 | 1/1980 | Copher et al. . | |
| 4,248,161 | 2/1981 | Adair et al. . | |
| 4,379,429 | 4/1983 | Gubbe et al. . | |
| 4,431,153 | 2/1984 | Kritske . | |
| 4,496,200 | 1/1985 | Hagstrom et al. . | |
| 4,545,554 | 10/1985 | Latino et al. | 248/118.1 |
| 4,546,708 | 10/1985 | Wilburth . | |
| 4,562,987 | 1/1986 | Leeds et al. . | |
| 4,616,798 | 10/1986 | Smeenge et al. . | |
| 4,625,657 | 12/1986 | Little et al. | 108/93 |
| 4,637,666 | 1/1987 | Worrell et al. . | |
| 4,644,875 | 2/1987 | Watt | 108/93 |
| 4,653,818 | 3/1987 | DeBruyn . | |
| 4,691,888 | 9/1987 | Cotterill . | |
| 4,717,112 | 1/1988 | Pirkle . | |
| 4,733,618 | 3/1988 | Sarro et al. . | |
| 4,843,978 | 7/1989 | Schmidt et al. | 108/138 |
| 5,040,760 | 8/1991 | Singer | 248/918 X |
| 5,041,770 | 8/1991 | Seiler | 248/918 X |
| 5,257,767 | 11/1993 | McConnell | 248/918 X |
| 5,292,097 | 3/1994 | Russell | 248/918 X |
| 5,294,087 | 3/1994 | Drabczyk et al. | 248/918 X |
| 5,513,579 | 5/1996 | Allan | 108/93 |

*Primary Examiner*—Ramon O. Ramirez
*Assistant Examiner*—Derek J. Berger
*Attorney, Agent, or Firm*—Michaele A. Hakamaki

[57] ABSTRACT

An articulated support assembly for a computer keyboard. The assembly includes a generally U shaped rigid support member, and a platform for supporting the keyboard pivotably mounted on a central portion of the support member. Projecting end portions of the support member are pivotably mounted on attachment members fixed to the bottom of a table or desk top. A releasable friction clutch restricts pivotal movement of the platform around the central portion of the support member. A releasable ratchet assembly prevents revolving movement of the central portion toward a lowered position relative to the attachment members. A switching mechanism can be manually activated to release the ratchet assemblies and the friction clutch so that the position and orientation of the platform relative to the table or desk top can be adjusted.

15 Claims, 12 Drawing Sheets

KEYBOARD SUPPORT ASSEMBLY

TECHNICAL FIELD

The present invention relates to articulated support assembly adapted for adjustably supporting a computer keyboard along one edge of a horizontal support member, and particularly to such support assembles that are attached to a bottom surface of the support member.

BACKGROUND ART

The art is replete with articulated support assemblies adapted for adjustably supporting a computer keyboard along one edge of a horizontal support member, including many such support assembles that are attached to a bottom surface of the support member.

Heretofore, however, known support assemblies of that type have either been supported from a centrally located support structure so that the assemblies presented obstacles that interfered with leg clearance for some individuals and/or the assemblies lacked stability in that forces applied at the ends of the supported keyboards resulted in large torsion forces causing rocking of the supported keyboards; or if the support assemblies have had support at the ends of the keyboard, they lacked the desired degree of adjustability to place the keyboard at a desired height above the floor.

DISCLOSURE OF INVENTION

The present invention provides an articulated support assembly adapted for adjustably supporting a computer keyboard along one edge of a horizontal support member, which support assembly both provides good stability for the ends of a supported keyboard, provides leg clearance for almost all persons, and provides adjustability to place the keyboard at almost any height above the floor that various individuals would desire (e.g., the assembly can provide a leg clearance area 20 inches wide and up to the bottom surface of the support member, and the bottom of the keyboard can be adjusted to heights between about 8 inches below and about 7.8 inches above the bottom surface of the support member.

According to the present invention there is provided an articulated support assembly comprising:

(1) two attachment members adapted to be attached to the bottom surface of a horizontal support member in spaced relationship adjacent its edge;

(2) a platform having an upper surface adapted to have a computer keyboard supported thereon;

(3) a generally U shaped rigid support member having an elongate central portion and generally parallel end portions projecting in the same direction from the opposite ends of the central portion;

(4) platform mounting means mounting the platform on the central portion of the support member for pivotal movement of the platform about the axis of the central portion axis with its upper surface parallel to the axis of the central portion;

(5) first releasable retaining means between the platform and the central portion moveable between a retaining position for restricting pivotal movement of the platform about the axis of the central portion, and a release position affording relatively free pivotal movement of said platform about the axis of the central portion;

(6) support member mounting means adapted for mounting the end portions of the support member on the attachment members for pivotal movement of the support member about a pivot axis parallel to the axis of the central portion so that the central portion of the support member can revolve about that pivot axis; and (7) second releasable retaining means between the support member mounting means and the attachment members moveable between an engaged position for preventing revolving movement of the central portion toward a lowered position relative to the attachment members, and a disengaged position for affording revolving movement of the central portion toward either a lowered or a raised position relative to the attachment members.

Preferably, the articulated support assembly also includes switching means adapted for manual actuation that is moveable between a normal position positioning the second releasable retaining means in the engaged position and the first releasable retaining means in the retaining position to afford supporting the platform at a predetermined position relative to the attachment members, and at least one adjustment position to position the second releasable retaining means in its disengaged position and to position the first releasable retaining means in its release position to afford adjusting the position and orientation of the platform relative to the attachment members.

The first releasable retaining means or friction clutch means between the platform and the central portion can include a plurality of pressure plates and friction discs, mounted around the central portion of the support member with each of the friction discs between two of the pressure plates. The friction discs are prevented from rotating relative to the central portion, and the pressure plates are prevented from rotating relative to the platform. The side surfaces of the pressure plates are biased against the side surfaces of the friction discs, and cam means are provided that are moveable between an engaged position at which the means for biasing presses the side surfaces of the pressure plates into frictional engagement with the side surfaces of the friction discs to restrict relative rotation therebetween and fix the position of the platform with respect to the central portion, and a disengaged position separating the pressure plates in opposition to the means for biasing at which the friction discs can rotate relative to the pressure plates, thereby affording rotation of the platform with respect to the central portion of the support member.

The second releasable retaining means or ratchet means can comprise an external gear attached to each of the attachment members coaxial with the pivot axis, a pawl assembly pivotably mounted on each of the support member mounting means comprising a pivot portion having a first end mounted for pivotal movement about a pivot portion axis parallel with the pivot axis, and a second end having an arcuate surface that is cylindrically concave about an axis parallel to the pivot axis that faces teeth on the gear, and a rocking portion having a cylindrically convex surface adapted to nest in the arcuate surface of the pivot portion and a plurality of teeth projecting along its side opposite the convex surface adapted to engage the teeth of said gear. The pivot and rocking portions are oriented so that the axis of the arcuate surface is below a straight line between the pivot axis and the pivot portion axis to cause the pivot portion to press the concave surface against the convex surface of the rocking portion and the teeth on the rocking portion into engagement with the teeth on the gear to prevent revolving movement of the central portion toward a lowered position relative to the attachment members, while causing upward movement of the support member relative to the attachment members to pivot the pivot portion and move the arcuate surface away from the gear to afford separation of the teeth on the rocking portion from the gear and afford revolving movement of the central portion toward a raised position relative to the attachment members. Upon reaching that raised position, a spring and the weight of the platform will again cause the pivot portion to press the concave surface against the convex surface of the rocking portion and the teeth on the rocking portion into engagement with the teeth on the gear to prevent revolving movement of the central portion toward a lowered position relative to the attachment members.

The switching means can comprise an elongate control bar having manually engageable means on at least one end that is mounted on the platform with an axis of the control bar parallel to and spaced from the axis of the central portion. The manually engageable means projects beyond the end of the platform and can be used to rotate the control bar about its axis between its normal position (to which it is biased) and its adjustment positions.

The articulated support assembly can optionally also include a mouse pad support plate having a planar upper surface adapted to support a mouse pad, and means for mounting the mouse pad support plate on the platform with its upper surface generally parallel to the upper surface of the platform. That means for mounting the mouse pad support plate can, optionally, afford adjusting the position of the mouse pad support plate between positions with portions of the mouse pad support plate overlying portions of the platform which can position the mouse above the number keys on a keyboard where it is very accessible to a user, and positions with the mouse support plate at one end of the platform which affords access to the number keys and still affords easy access to the mouse. The mouse pad support plate can have one portion of a releasable fastener means attached to a vertically disposed surface along one edge of its mouse pad support surface that is releasably engageable by a second portion of a releasable fastener means on a mouse so that the mouse can be releasably retained on a mouse pad along the mouse support surface. Such releasable retaining of the mouse is very useful when the position of the platform is changed so that the mouse does not fall off the mouse pad.

Also, a wrist rest can be provided on either or both of the keyboard support platform and the mouse pad support plate, which wrist rest can support a users wrists on a pad containing a layer of solid gel.

BRIEF DESCRIPTION OF DRAWING

The present invention will be further described with reference to the accompanying drawing wherein like reference numerals refer to like parts in the several views, and wherein.

DETAILED DESCRIPTION

Figure 9:
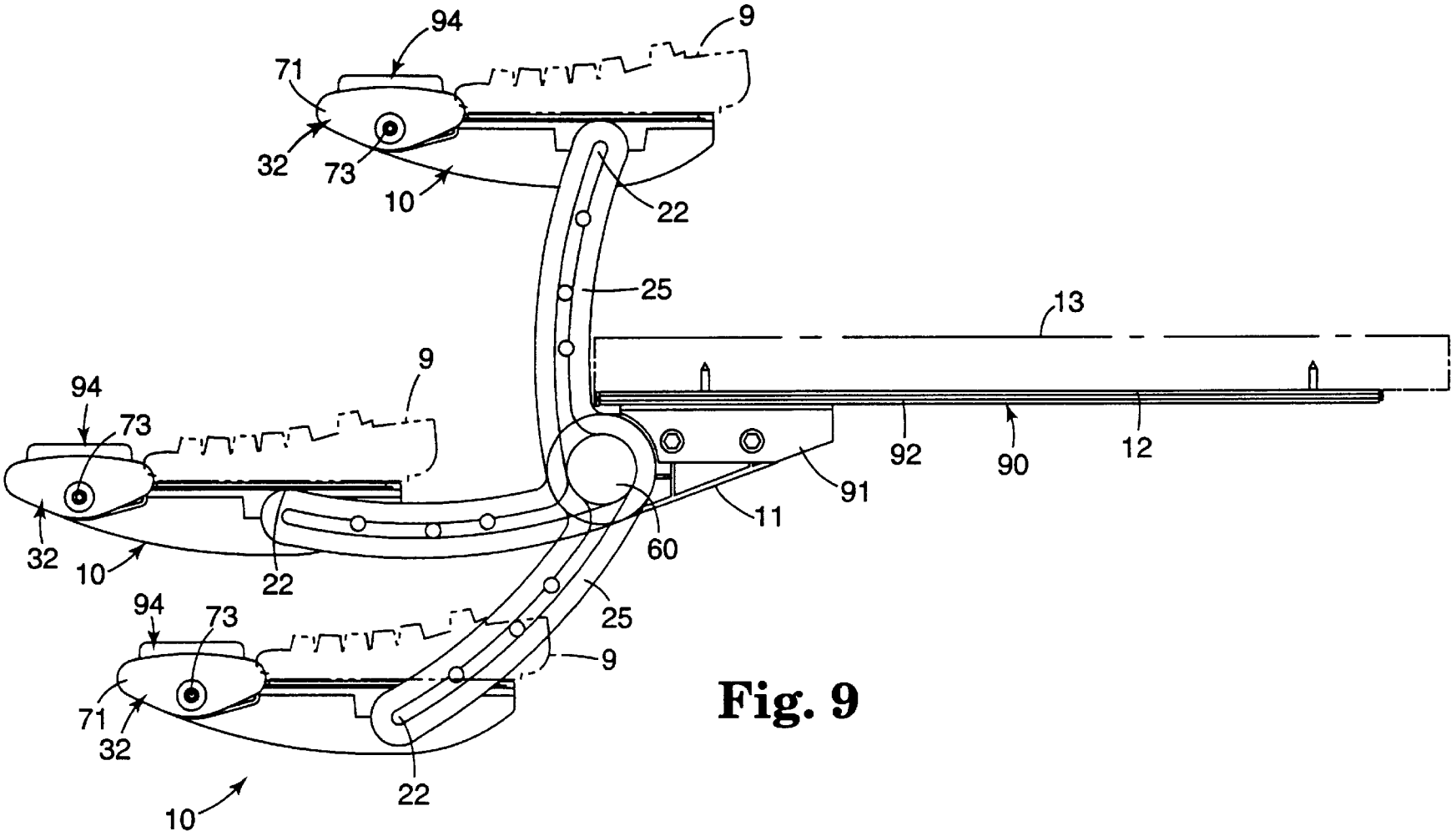
FIG. 9 is an end view of the articulated support assembly of FIG. 1 shown supporting a keyboard and attached to a horizontal support member and illustrating a range of positions in which the support assembly can be placed.
Figure 10:
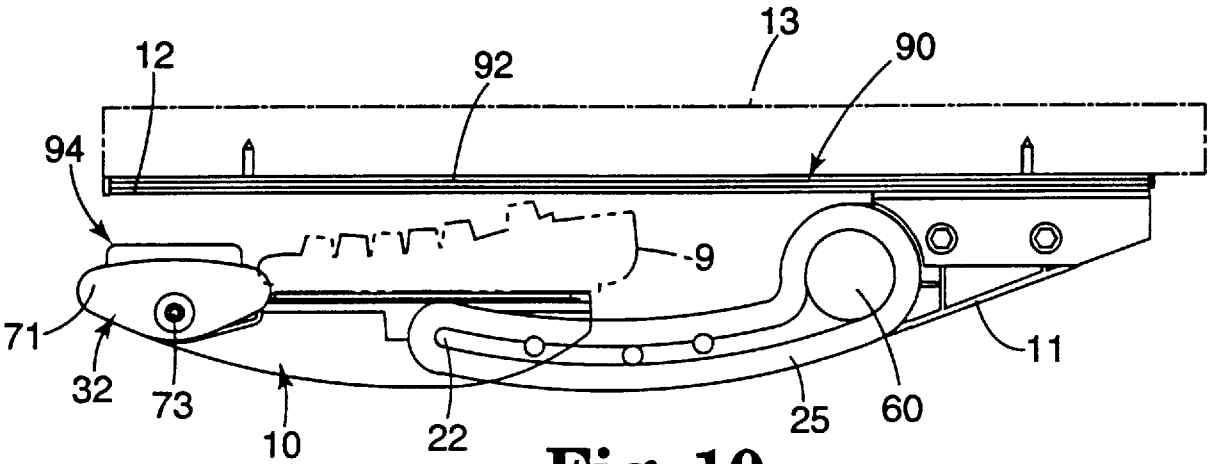
FIG. 10 is an end view of the articulated support assembly of FIG. 1 shown supporting a keyboard and attached to a horizontal support member and illustrating a storage position in which the support assembly can be placed.

Referring now to FIGS. 1–13 of the drawing, there is shown a articulated support assembly 10 according to the present invention that is adapted for adjustably supporting a computer keyboard 9 along one edge of a horizontal support member 13 (e.g., a desk or table top) that has a bottom surface 12 (see FIGS. 9, and 10).

Generally the articulated support assembly 10 comprises two attachment members 11 adapted to be attached to the bottom surface 12 of the horizontal support member 13 in spaced relationship adjacent its edge. Also included is a platform 16 having a generally planar upper surface 18 adapted to have a computer keyboard supported thereon, which platform 16 has upper and lower portions that have inner surfaces defining a cavity 19 within the platform 16; and a generally U shaped rigid support member 20 including an elongate central portion 21 having a central portion axis 22 and generally parallel end portions 23 projecting in the same direction from the opposite ends of the central portion 21. Platform mounting means mount the platform 16 on the central portion 21 with the central portion 21 extending through the cavity 19 for pivotal movement of the platform 16 about the axis 22 of the central portion 21 with the upper surface 18 of the platform 16 parallel to the axis 22 of the central portion 21. First releasable retaining means or friction means 26 within the cavity 19 between the platform 16 and the central portion 21 are moveable between a retaining position for restricting pivotal movement of the platform 16 about the axis 22 of the central portion 21, and a release position affording relatively free pivotal movement of the platform 16 about the axis 22 of the central portion 21. Also included are support member mounting means 28 adapted for mounting the end portions 23 of the support member 20 on the attachment members 11 for pivotal movement of the support member 20 about a pivot axis 24 parallel to the axis 22 of the central portion 21, thereby affording revolving of the central portion 21 about the pivot axis 24, Second releasable retaining means or ratchet means 30 are provided between the support member mounting means 28 and the attachment members 11 that is moveable between an engaged position (FIG. 5) that prevents revolving movement of the central portion 21 toward a lowered position relative to the attachment members 11, and a disengaged position (FIG. 6) that affords revolving movement of the central portion 21 toward either a lowered or a raised position relative to the attachment members 11. The articulated support assembly 10 also includes switching means 32 adapted for manual actuation and moveable between a normal position positioning the ratchet means 30 in its engaged position and the friction means 26 in its retaining position to afford supporting the platform 16 at a predetermined position relative to the attachment members 11; and adjustment positions, one of which positions the ratchet means 30 in the disengaged position and another of which positions the friction means 26 in the release position to afford adjusting the position and orientation of the platform 16 relative to the attachment members 11.

Figure 2:
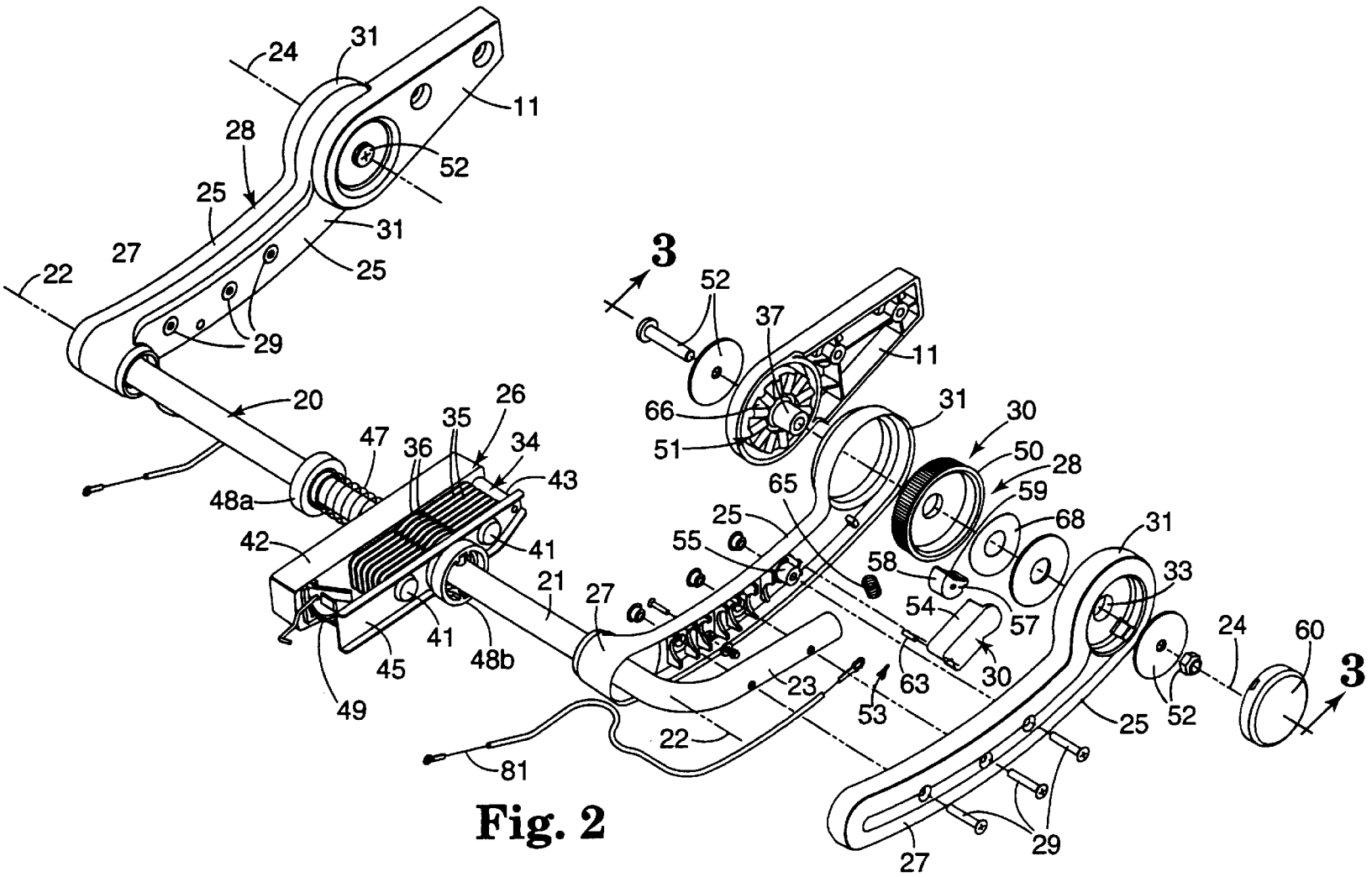
FIG. 2 is a perspective view of parts of the articulated support assembly of FIG. 1 including a friction clutch means on a support member and a partially exploded view of support member mounting means included in the assembly.
Figure 4:
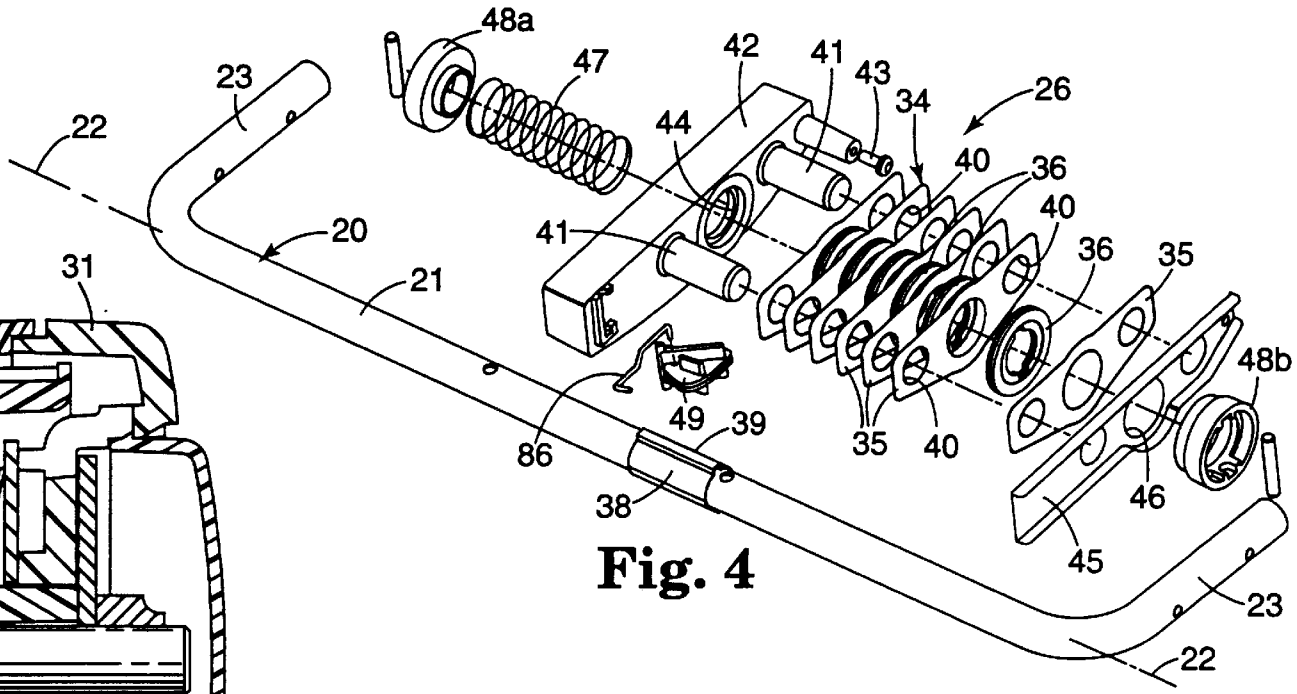
Figure 4 is a perspective exploded view of the friction clutch means and the support member illustrated in FIG. 2.
Figure 3:
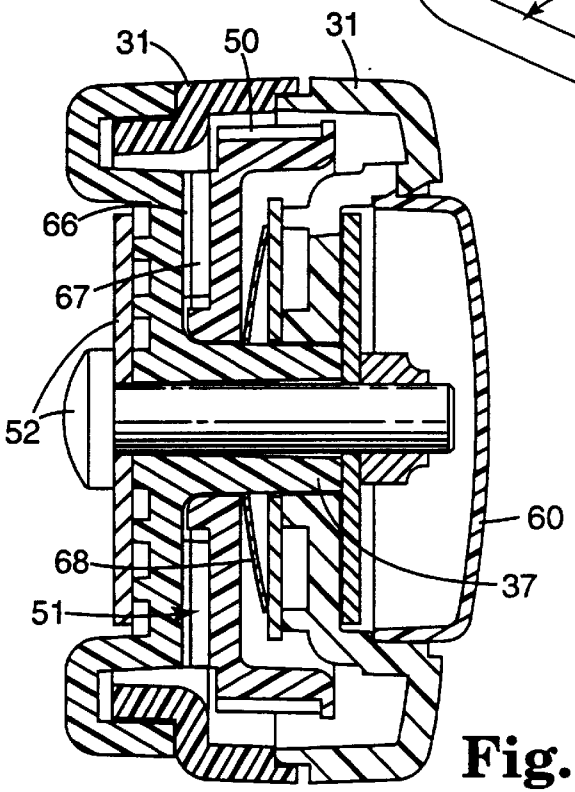
FIG. 3 is an enlarged sectional view taken approximately along line 3—3 of FIG. 2.
Figure 7:
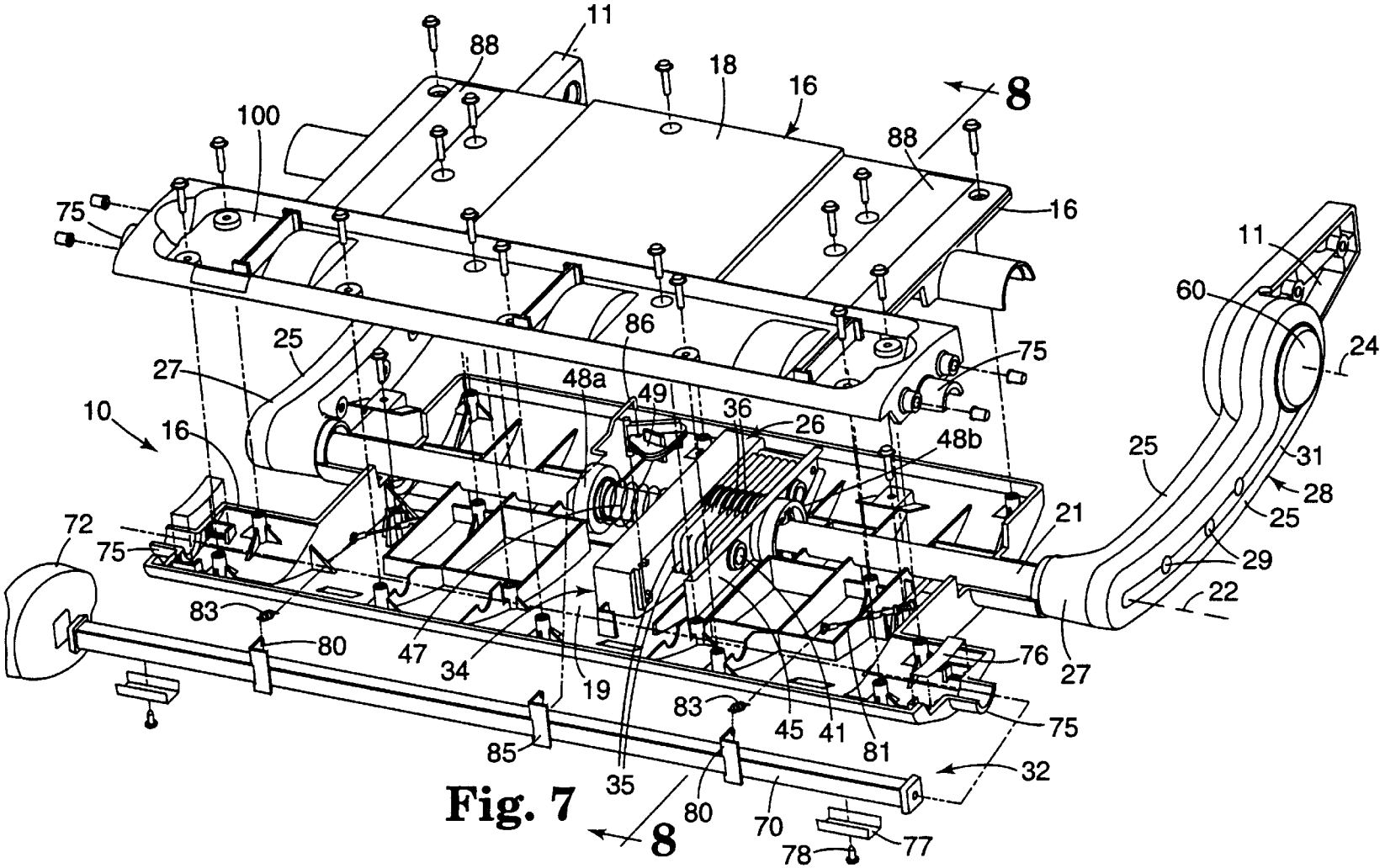
FIG. 7 is a perspective, partially exploded view of the articulated support assembly of FIG. 1 from which a wrist rest has been removed.
Figure 8:
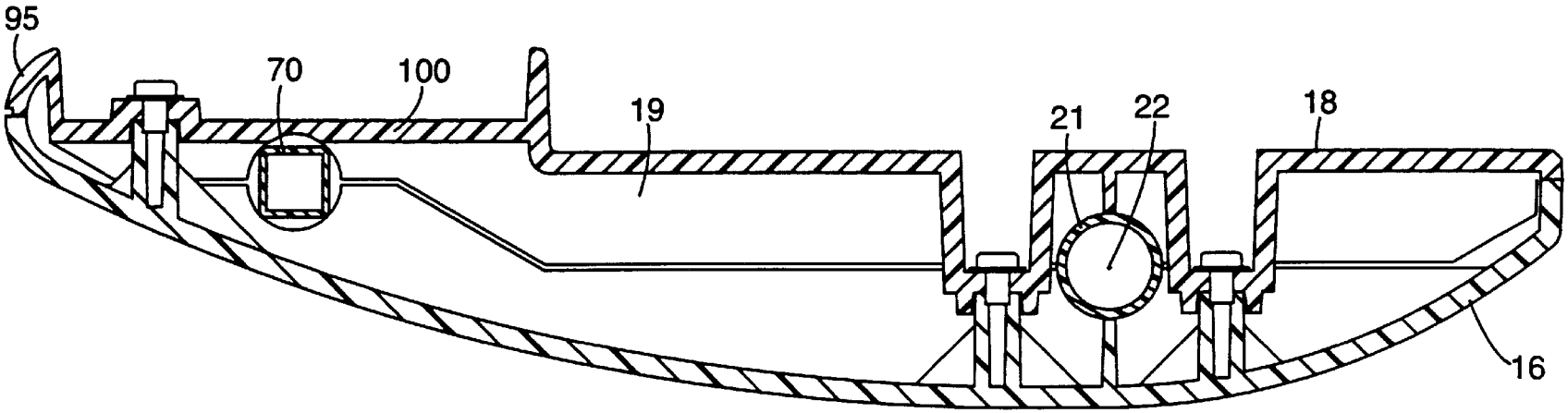
FIG. 8 is a sectional view taken approximately along line 8—8 of FIG. 7.

As is best seen in FIGS. 2, 4, and 7, the friction means 26 in the cavity 19 between the platform 16 and the central portion 21 comprises a clutch assembly 34.

The clutch assembly 34 includes a plurality of pressure plates 35 and friction discs 36 having side surfaces with annular portions of about the same diameter. The pressure plates 35 and friction discs 36 are mounted around the central portion 21 of the support member 20 with their side surfaces projecting radially with respect to its axis and with each of the friction discs 36 between two of the pressure plates 35. Each pressure plate 35 and friction disc 36 has a through opening larger than the central portion 21 through which the central portion 21 extends, which through openings are sized so that the friction discs 36 and pressure plates 35 can slide axially along the central portion 21. Rotation of the friction discs 36 relative to the central portion 21 is prevented by a sleeve 38 fixed to the central portion 21 that has two opposite raised axially extending rectangular portions 39 slidably received in rectangular slots in the friction discs 36. The central openings of the pressure plates 35 are of sufficient diameter to allow the pressure plates 35 to rotate around the rectangular portions 39, however, means later to be explained prevents rotation of the pressure plates 35 around the central portion 21 relative to the platform 16. The pressure plates 35 have opposite outwardly projecting ends with through openings 40 in which are slidably received posts 41 projecting from an arm 42. The posts 41 are parallel to each other and to the central portion 21 and are on opposite sides of an opening 44 through the arm 42 in which the central portion 21 is positioned. The posts 41 extend through and are slidably received in openings in an end pressure plate 45 on opposite sides of an opening 46 through the end pressure plate 45 in which the central portion 21 is positioned. The peripheries of the arm 42 and end pressure plate 45 correspond in shape to a portion of the inner surface of the platform 16 that defines the cavity 19 so that the arm 42, pressure plates 35, and end pressure plate 45 can not rotate relative to the platform 16 around the central portion 21, however all are slideable along the central portion 21. Means in the form of a spring 47 between the arm 42 and a first collar 48*a* fixed by a pin along the central portion 21 is provided for biasing the arm 42 toward the end pressure plate 45 which is positioned against a second collar 48*b* also pinned to the central portion 21. The spring 47 thus can bias the side surfaces of the pressure plates 35 against the side surfaces of the friction discs 36. Cam means including a cam 49 pivotably mounted on the arm 42 is moveable between (1) an engaged position of the clutch assembly 34 at which the cam 49 is spaced from between the arm 42 and an end pressure plate 45 to allow the spring 47 to press the side surfaces of the pressure plates 35 against the side surfaces of the friction discs 36 to cause friction therebetween and thereby restrict relative rotation between the platform 16 and the central portion 21 to fix the position of the platform 16 with respect to the central portion 21; and (2) a disengaged position of the clutch assembly 34 with the cam 49 between and separating the arm 42 from the end pressure plate 45 around an adjustable pivot defined by a screw 43 at the opposite ends thereof in opposition to the spring 47 to thereby afford relative rotation between the friction discs 36 and the pressure plates 35 and rotation of the platform 16 with respect to the central portion 21.

The support member mounting means 28 adapted for mounting the end portions 23 of the support member 20 on the attachment members 11 for pivotal movement about the pivot axis 24 comprises two pairs 25 of mating polymeric moldings. Each pair 25 of mating polymeric moldings forms an outer end portion 27 that encloses an end part of the central portion 21 and one of the end portions 23 of the support member 20 to which the end portion 23 is attached by bolts 29; and a pivot end 31 that has cylindrical inner surface 33 journaled on a cylindrical projection 37 from the attachment member 11. Engagement of the pivot ends 31 with the attachment members 11 is maintained by a bolt and washer assembly 52 that extends through openings in the attachment members 11 and in the pivot end 31, with a nut of the bolt and washer assembly 52 being covered by an end cap 60 for decorative purposes.

Figure 5:
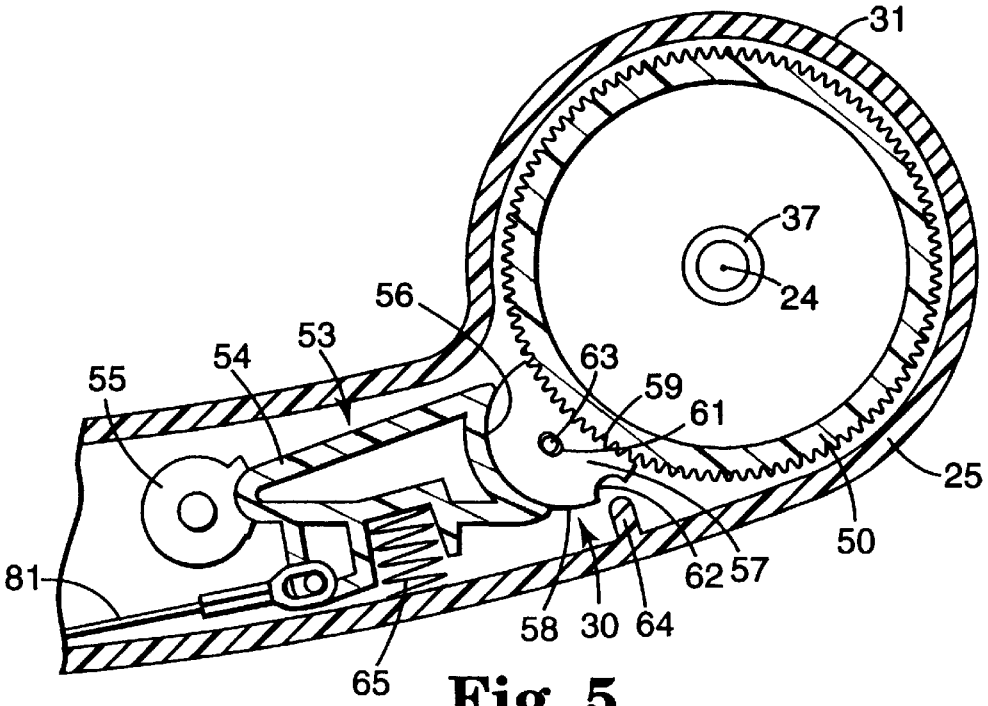
FIG. 5 is an enlarged fragmentary sectional view taken approximately along line 5—5 of FIG. 2 and illustrating a ratchet means in an engaged position.
Figure 6:
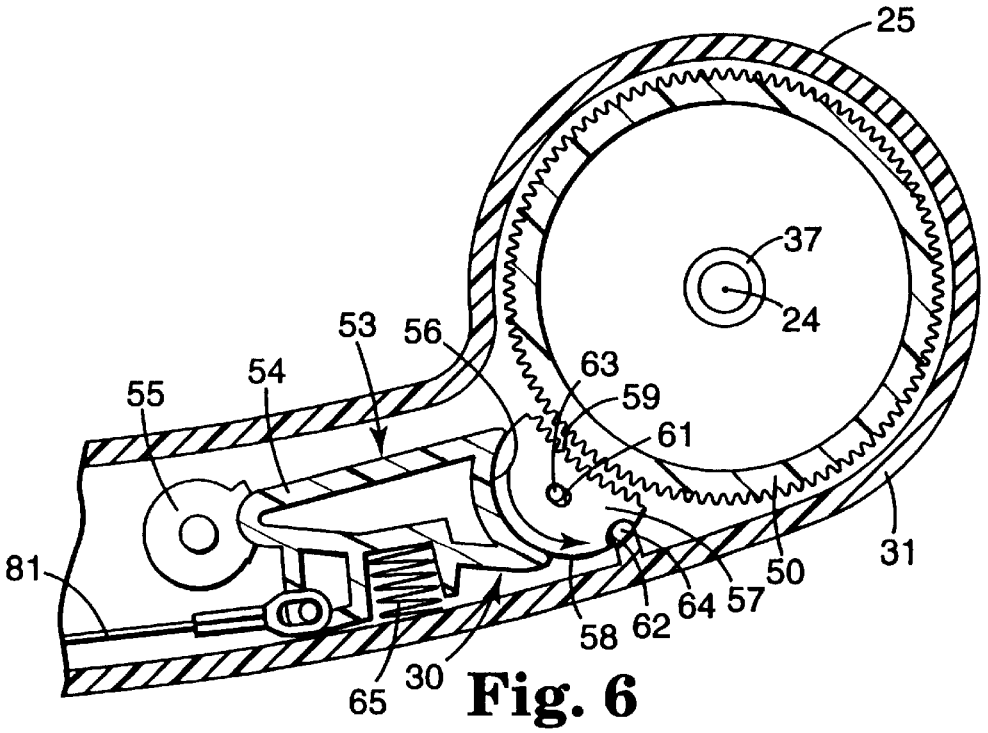
FIG. 6 is an enlarged fragmentary sectional view taken approximately along line 5—5 of FIG. 2 and illustrating a ratchet means in a disengaged position.

The ratchet means 30 between the distal end portions 23 and the attachment members 11 that is moveable between its engaged position preventing revolving movement of the central portion 21 toward a lowered position relative to the attachment members 11, and its disengaged position for affording revolving movement of the central portion 21 toward either a lowered position or a raised position relative to the attachment members 11 is best seen in FIGS. 2, 5, and 6. The ratchet means 30 comprises an external gear 50 rotatable around the cylindrical surface 37 and attached to each of the attachment members 11 by slip clutch means 51 (later to be explained) with an axis of the gears 50 coaxial with the pivot axis 24. A pawl assembly 53 is pivotably mounted on the inner one of each pair 25 of mating polymeric moldings and within its pivot end 31. The pawl assembly 53 comprises a pivot portion 54 having an arcuate first end mounted in a concave recess in a boss 55 on that molding for pivotal movement about a pivot portion axis parallel with the pivot axis 24, and a second end having an arcuate surface 56 that is cylindrically concave about an axis parallel to the pivot axis 24 and faces the teeth on the gear 50. The pawl assembly 53 also includes a rocking portion 57 having a cylindrically convex surface 58 on a first side adapted to nest in the arcuate surface 56 of the pivot portion 54 and a plurality of teeth 59 projecting along a second side adapted to engage the teeth of the gear 50. The pivot and rocking portions 54 and 57 are oriented with the axis of the arcuate surface 56 below a straight line between the pivot axis 24 and the pivot portion axis defined by the boss 55, toward which straight line the pivot and rocking portions 54 and 57 are biased by a spring 65 between the molding 25 and the pivot portion 54. This causes the pivot portion 54 to press the concave surface 56 against the convex surface 58 of the rocking portion 57 and the teeth 59 on the rocking portion 57 into engagement with the teeth on the gear 50 to prevent revolving movement of the central portion 21 toward a lowered position relative to the attachment members 11.

Upward revolving movement of the support member 20 relative to the attachment members 11, however, will pivot the pivot portions 54 against the bias of the springs 65 and move the arcuate surfaces 56 away from the gears 50 to afford separation of the teeth 59 on the rocking portions 57 from the gears 50 to afford that revolving movement of the central portion 21 toward a raised position relative to the attachment members 11. Upon reaching that raised position, the spring 65 will again cause the pivot portion 54 to press the concave surface 56 against the convex surface 58 of the rocking portion 57 and the teeth 59 on the rocking portion 57 into engagement with the teeth on the gear 50 to prevent revolving movement of the central portion 21 toward a lowered position relative to the attachment members 11.

Each rocking portion 57 has a guide surface defining a through slot 61 generally at the axis of the cylindrically convex surface 58 and a side surface defining a recess 62 along the side of the rocking portion 57 opposite the straight line between the pivot axis and the pivot portion axis. The associated pivot portion 54 includes a pin 63 that projects through the slot 61 and is adapted to engage the guide surface to carry the rocking portion 57 on the pivot portion 54 and provides a pivot axis for the rocking portion 57 to pivot the teeth 59 on the rocking portions 57 that are adjacent the recess 62 out of engagement with the teeth on the gear 50 around teeth on the rocking portion 57 that are positioned opposite the recess 62 and initially remain engaged with teeth on the gear 50 when upward movement of the support member 20 relative to the attachment members 11 is initiated. The molding 25 has a lug or pin 64 adapted to be engaged by the surface defining the recess 62 when the teeth 59 adjacent the recess 62 pivot out of engagement with the teeth on the gears 50 to restrict further pivoting of the teeth 59 adjacent the recess 62 away from the gear 50 and cause opposite pivot motion of the rocking portions 57 about the pins 63 and 64 to cause the teeth 59 opposite the recess 62 to separate from the gear 50 during further upward movement of the support member 20 relative to the attachment members 11. Alternatively, the ratchet means 30 can be moved to their disengaged positions by pivoting the pivot portions 54 relative to the end parts 23 while rotating the end parts 23 slightly upwardly to move the arcuate surfaces away from the gears 50 and cause engagement of the pins 63 and 64 with the surfaces defining the slots 61 and the recesses 62 to cause retraction of the teeth 59 on the rocking portions 57 to positions spaced from the teeth on the gears 50 (FIG. 6).

The articulated support assembly further includes the slip clutch means 51 between the end portions 23 and the attachment members 11 for affording revolving movement of the platform 16 on the central portion 21 toward a lowered position relative to the attachment members 11 in response to application of a downward force on the platform 16 above a predetermined minimum. That slip clutch means 51 (see FIGS. 2 and 3) includes a plurality of radially extending ridges 66 with generally semi-cylindrical surfaces on the attachment members 11, a plurality of radially extending channels 67 with rectangular cross sections in the gears 50 that are adapted to receive the ridges 66 on the attachment members 11, and means in the form of arcuate spring washers 68 that are partially flattened by the bolt and washer assemblies 52 to bias the ridges 66 on the attachment members 11 into the channels 67 in the gears 50 so that cam like interaction of surfaces defining the ridges 66 and recesses 67 will only further flatten the spring 68 sufficiently to allow the ridges 66 to slip out of the recesses 67 when a predetermined amount of torque is applied therebetween because of a downward force on the platform 16 above a predetermined minimum.

Figure 1:
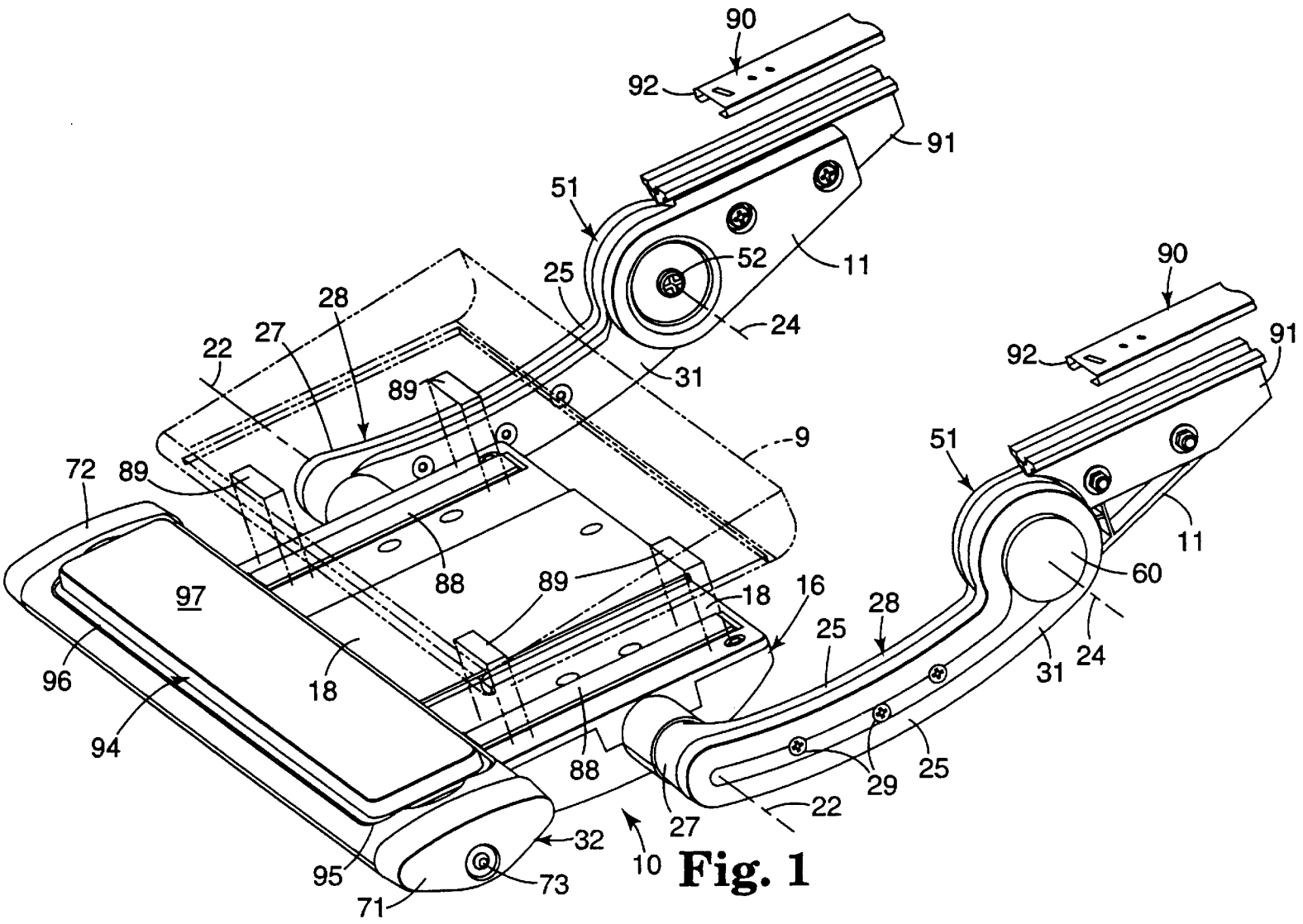
Figure 1 is a perspective view of a first embodiment of an articulated support assembly according to the present invention together with a keyboard the assembly is adapted to support shown in phantom outline.

The switching means 32 which is adapted for manual actuation and is moveable between its normal and adjustment positions comprises an elongate control bar 70 having opposite ends with at least one end, and, as illustrated in FIG. 1, both ends having attached thereto manually engageable means in the form of end caps 71 and 72 (i.e., rectangular end portions of the control bar 70 are received in close fitting sockets in the end caps 71 and 72 and are retained therein by cap screws 73). The control bar 70 is mounted on the platform 16 with its longitudinal axis parallel to and spaced from the axis of the central portion 21 and with the manually engageable means or end caps 71 and 72 projecting beyond the platform 16 by means that facilitate manual rotation of the control bar 70 about its axis between its normal positions and its adjustment position, while the control bar 70 is biased toward its normal position. That means for mounting the control bar 70 comprises mating projections 75 (see FIG. 7) defining cylindrical inner surfaces at both ends of the platform 16 in which projections 75 end portions of the square control bar 70 are journaled. An slightly arcuate flat spring 76 is mounted on the lower portion of the platform 16 in the cavity 19 and is biased against a U-shaped channel 77 of polymeric material fixed along the bottom surface of the bar 70 by a screw 78. The spring 76 biases the bar 70 to its normal position with the flat side of the channel 77 aligned with the flat surface of the spring 76, while being deflectable to afford rotation of the bar 70 to its adjustment positions when a user manually rotates one or both of the end caps 71 and 72. The bar 70 has two radially projecting first actuating portions 80 coupled to the pivot portions 54 of the pawl assemblies 53 by springs 83 and cables 81 in casings (e.g., casings of molybdenum disulfite filled nylon material) fixed to the platform 16. The bar 70 also has a radially projecting second actuating portion 85 coupled by a rigid actuating rod 86 to the cam 49. By these connections, rotation of the control bar 70 counter clockwise as viewed from the right hand end in FIG. 7 to one of its adjustment positions relative to the platform 16 by manually rotating one of the end caps 71 or 72 while slightly lifting the platform 16 will move both pawl assemblies 53 to place the ratchet means 30 in its disengaged position by movement of the pivot and rocking portions 54 and 57 away from the gears 50 (the cam 49 will also move but will not position the clutch assembly 34 in its disengaged portion); whereas rotation of the control bar 70 counter clockwise as viewed from the right hand end in FIG. 7 to the other of its adjustment positions relative to the platform 16 by manually rotating one of the end caps 71 or 72 will move the cam 49 to position the clutch assembly 34 in its disengaged position (the cables 81 will bend during such movement and will not move the pawl assemblies 53). The platform 16 and thereby the keyboard 9 can thus either be raised or lowered relative to the attachment members 11 or can be pivoted around the central portion 21 of the support member 20 to a desired orientation. Alternatively, the connections could be made so that rotation of the control bar 70 in one direction by manually rotating one of the end caps 71 or 72 while slightly lifting the platform 16 will both move both pawl assemblies 53 to place the ratchet means 30 in its disengaged position, and move the cam 49 to position the clutch assembly 34 in its disengaged position, however, adjusting both height and orientation of the platform 16 at the same time can be more difficult than adjusting them one at a time.

The articulated support assembly 10 can further include one portion 88 of a releasable fastener means attached to the upper surface 18 of the platform 16 and adapted to be releasably engaged by a second portion 89 of the releasable fastener means attached on the bottom surface of the keyboard 9 (see FIG. 1) to releasably retain the keyboard 9 along the upper surface 18 of the platform 16. A preferred releasable fastener means for this purpose is that sold under the trade designation "Dual Lock" by Minnesota Mining and Manufacturing Company, St. Paul, Minn.

The attachment members 11 can be attached directly to the bottom surface 12 of the support member 13 to which the articulated support assembly 10 is to be attached. Alternatively, as illustrated in FIGS. 9 and 10, the articulated support assembly 10 can include a slide assembly 90 attached to each of the attachment members 11. Each of the slide assemblies 90 is of a conventional structure and comprises an elongate traveling portion 91 disposed at a right angle to the pivot axis 24 and fixed to one of the attachment members 11, and a second elongate rail portion 92 attached to the bottom surface 12 of the horizontal support member 13 with one end at the edge of the support member 13. Parts of the traveling portions 91 are received in and slide longitudinal along the elongate rail portions 92. With the traveling portions 91 at the ends of the rail portions 92 adjacent the edge of the support member 13, the platform 16 projects beyond its edge and can be moved to various height positions relative to its bottom surface 12 (see FIG. 9 for three illustrative examples of such height positions). The traveling portions 91 can also be moved to the ends of the rail portions 92 opposite the edge of the support member 13 to position the platform 16 and the keyboard 9 it supports along the bottom surface 12 of the support member 13 (see FIG. 10).

The articulated support assembly 10 also includes a wrist rest assembly 94 for the user of the keyboard 9. The platform 16 has an elongate part 95 having first and second ends along the side of the upper surface 18 normally opposite the attachment members 11. An elongate pad support portion 96 is supported on the elongate part 95 and has a planar upper surface on which is supported an elongate pad assembly 97 comprising a layer of solid resiliently flexible gel enclosed in a soft covering material. The pad assembly 97 has a sufficient thickness between its top and bottom surfaces to afford supporting a users wrists on its top surface with a portion of the layer of gel beneath and conforming to the supported wrists and to afford significant motion of the top surface of the pad with the supported wrists in a horizontal plane relative to the bottom surface of the pad assembly. The pad support portion 96 is received in a socket 100 in the elongate part 95 of the platform 16, and the pad support portion 96 and the elongate part 95 of the platform 16 have different parts adapted for engagement to support the top surface of the pad assembly 97 at different levels with respect to the platform 16 in a first relative orientation when first ends of the pad support portion 96 and the elongate part 95 of the platform 16 are adjacent and in a second relative orientation when the first end of the pad support portion 96 is adjacent a second end of the elongate part 95 of the platform 16 (e.g., in the first relative orientation the top surface of the pad assembly 97 is about 1 inch above the upper surface 18 of the platform 16, and in the second relative orientation the top surface of the pad assembly 97 is about 1.4 inches above the upper surface 18 of the platform 16). Thus a user can select a level that he or she most prefers at which the top surface of the pad assembly 97 will support his or her wrists during use of the keyboard 9. This wrist rest assembly 94 is made in accordance with the teachings of U.S. patent application Ser. No. 08/324,734 filed Oct. 18, 1994, and U.S. Provisional Application No. 60/000,229 filed Jun. 15, 1995, the contents whereof are incorporated herein by reference.

Figure 11:
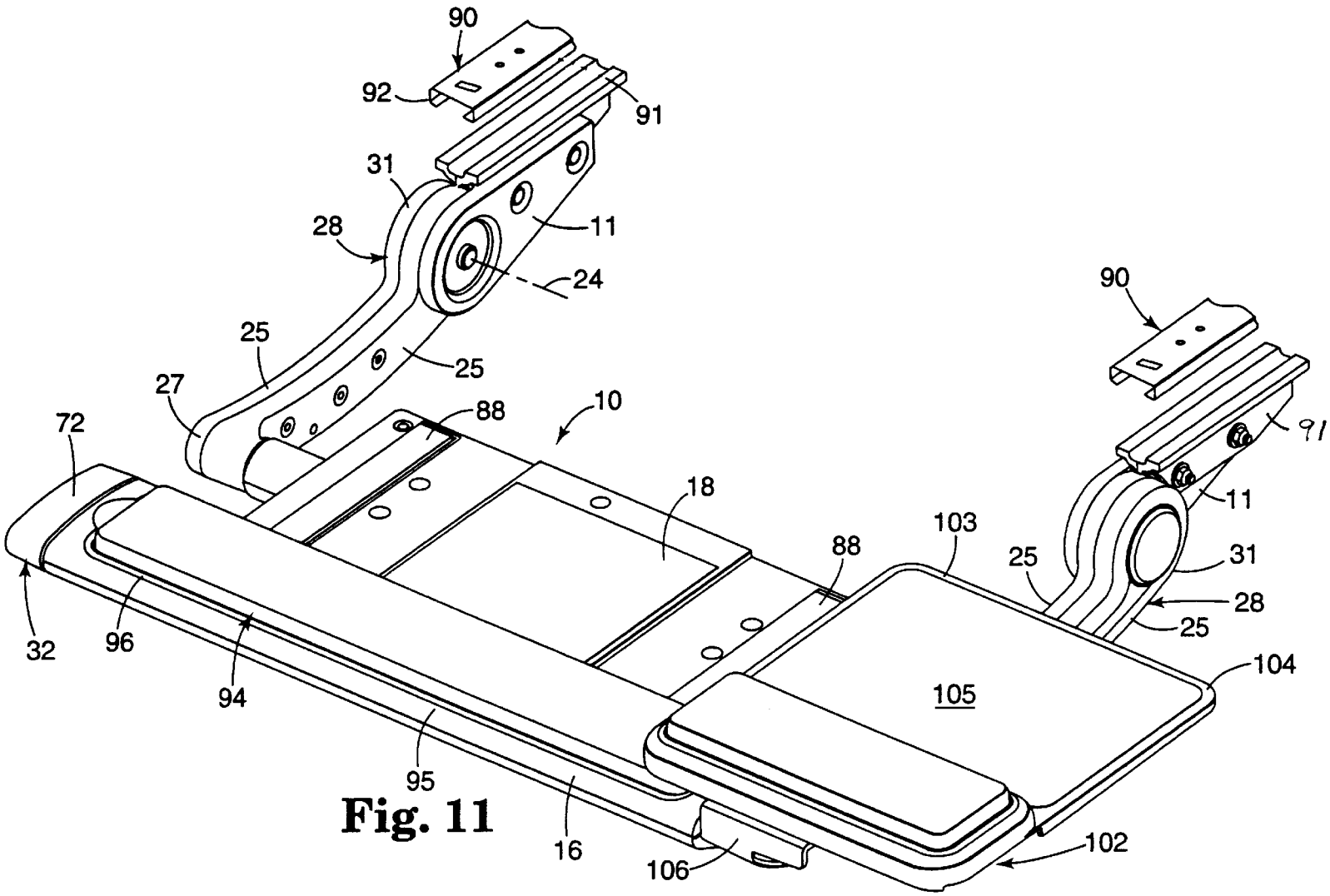
FIG. 11 is a perspective view of the articulated support assembly of FIG. 1 that has been modified to include an adjustable mouse support plate.
Figure 12:
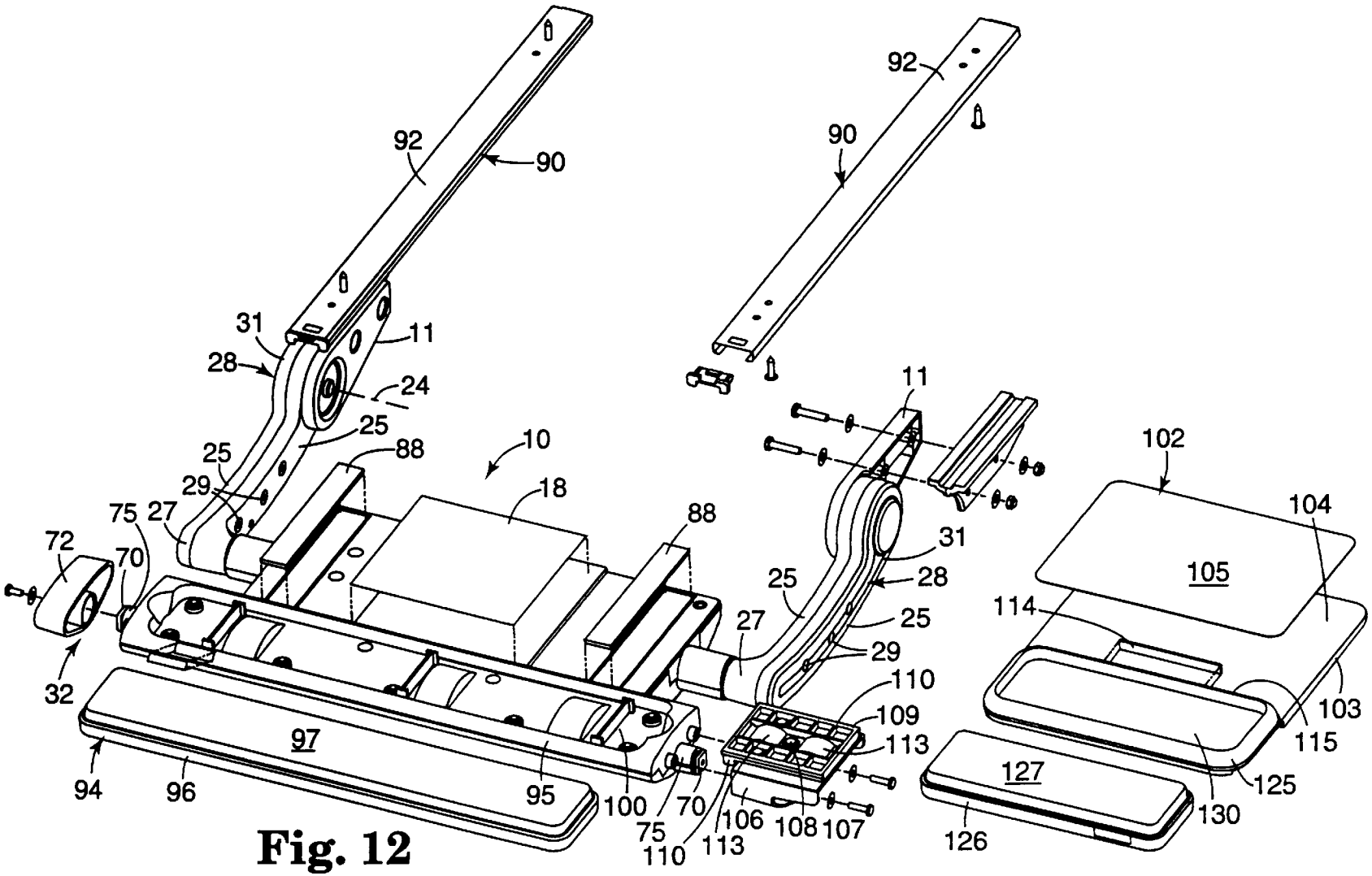
FIG. 12 is a perspective, partially exploded view of the modified articulated support assembly of FIG. 11.
Figure 13:
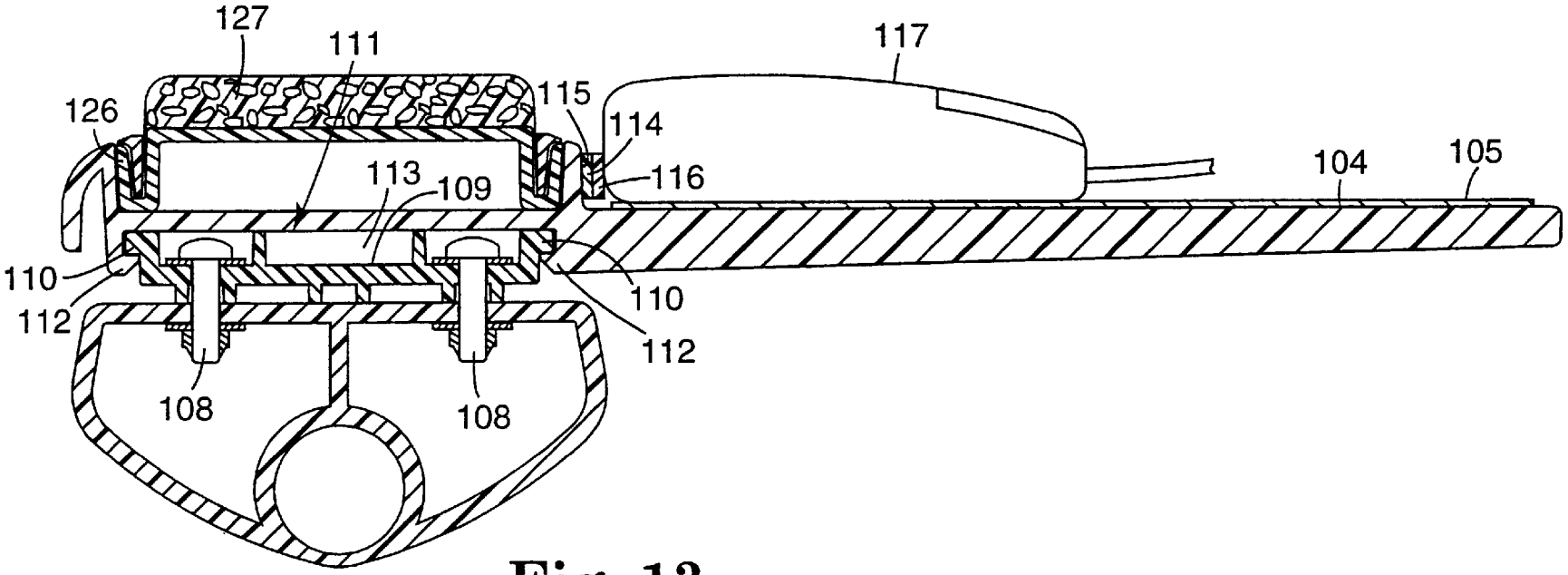
FIG. 13 is a partial sectional view taken approximately along line 13—13 of FIG. 11.

The articulated support assembly 10 can be adapted to further include a mouse support assembly 102 (see FIGS. 11, 12, and 13) including a mouse pad support plate 103 having a planar upper surface 104 adapted to support a mouse pad 105 (e.g., the thin polymeric mouse pad 105 sold under the trade designation "Precise Mousing Surface" by Minnesota Mining and Manufacturing Company, St. Paul, Minn.), and means for mounting the mouse support assembly 102 on the platform 16 with the planar upper surface 104 of the mouse pad support plate 103 generally parallel to and raised above the upper surface 18 of the platform 16. The means for mounting the mouse support assembly 102 includes means for adjusting the position of the planar upper surface 104 with respect to the platform 16 between positions with portions of the planar upper surface 104 overlying portions of the platform 16 to afford positioning a portion of the keyboard 9 therebetween (i.e., the portion on which the number keys are located), and positions with the planar upper surface 104 at one end of the platform 16. The means for mounting the mouse support assembly 102 on the platform 16 comprises a fixed support member 106 that is attached by screws 107 in a fixed position at one of the ends of the platform 16 after the end cap 71 or 72 at that end is removed. Attachment of the fixed support member 106 at the right end of the housing platform 16, which is normally preferred for right handed users, is illustrated in FIGS. 11, 12, and 13. The screws 107 that attach the fixed support member 106 to the platform are received in arcuate slots that allow the support member to be attached with the planar upper surface 104 tilted up to 10 degrees in either direction around the axis 22 with respect to the upper surface 18 of the platform. Attached along a top surface of the fixed support member 106 by bolt assemblies 108 is a rail member 109 having opposite outwardly projecting ridges 110 along its top surface opposite the fixed support member 106. Along a front edge of the mouse pad support plate 103 is a channel 111 defined by opposed inwardly projecting ridges 112 (see FIG. 13). A portion of the rail member 109 is received in the channel 111 with its ridges 110 over the ridges 112 of the mouse pad support plate 103. The channel 111 of the mouse pad support plate 103 can be slid along the rail member 109 to provide the positions of the planar upper surface 104 described above, at which positions it is frictionally retained by the pressure of arcuate portions of a leaf spring 113 attached to the rail member 109 against the adjacent surface of the movable mouse pad support plate 103.

The moveable mouse pad support plate 103 has a generally vertically disposed surface 115 projecting above the planar upper mouse pad support surface 104 and the mouse pad 105 along one side of that planar upper surface 104. One portion 114 of a releasable fastener means (e.g., a hook and loop fastener) is attached to that vertically disposed surface 115 and is adapted to be releasably engaged by a second portion 116 of that releasable fastener means on a mouse 117 (only in FIG. 13) to releasably retain that mouse 117 along the vertically disposed surface 115 and on the mouse pad 105. Such releasable retaining of the mouse 117 on the mouse pad 105 is very useful when the position of the platform 16 is changed so that the mouse 117 does not fall off the mouse pad 105.

The mouse support assembly 102 also includes a wrist rest assembly 124 for the user of a mouse on the mouse pad 105. The mouse pad support plate 103 has an elongate part 125 having first and second ends along the side of the planar upper surface 104 normally opposite the attachment members 11 when the mouse support assembly 102 is in use. An elongate pad support portion 126 is supported in a socket 130 on the elongate part 125 and has a planar upper surface on which is supported an elongate pad assembly 127 comprising a layer of solid resiliently flexible gel enclosed in a soft covering material. The pad assembly 127 has a sufficient thickness between its top and bottom surfaces to afford supporting a users wrists on its top surface with a portion of the layer of gel beneath and conforming to the supported wrists and to afford significant motion of the top surface of the pad with the supported wrists in a horizontal plane relative to the bottom surface of the pad assembly. Optionally, the pad support portion 126 and the elongate part 125 of the mouse pad support plate 103 could have different parts (not illustrated) adapted for engagement to support the top surface of the pad assembly 127 at different levels with respect to the mouse pad support plate 103 in a first relative orientation when first ends of the pad support portion 126 and the elongate part 125 of the mouse pad support plate 103 are adjacent and in a second relative orientation when the first end of the pad support portion 126 is adjacent a second end of the elongate part of the mouse pad support plate 103 so that a user could select a level that he or she most prefers at which the top surface of the pad assembly 127 will support his or her wrists during use of the mouse. This wrist rest assembly 124 is also made in accordance with the teachings of the aforementioned U.S. patent application Ser. Nos. 08/253,510 and 60/000,229.

Figure 14:
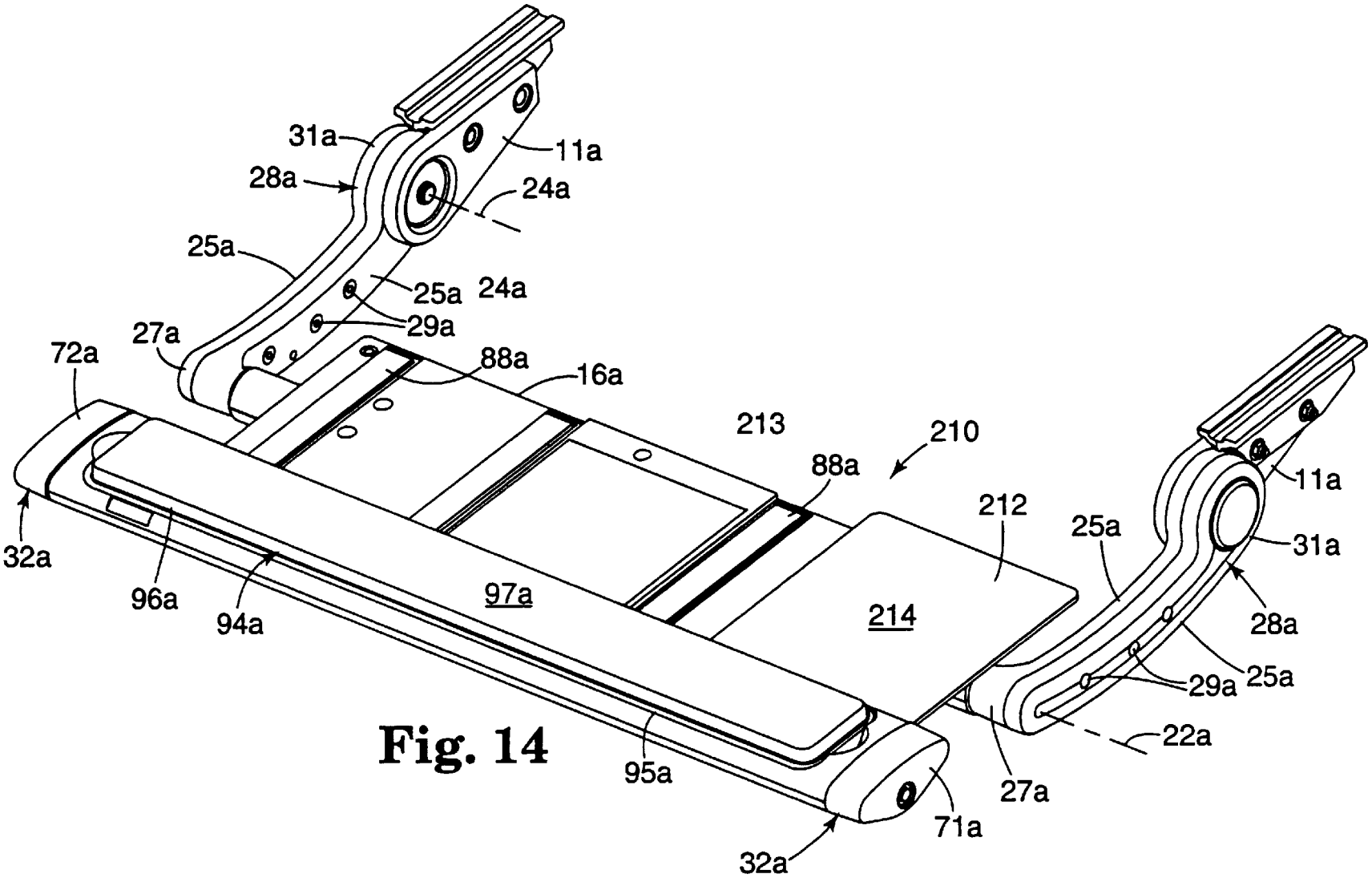
FIG. 14 is a perspective view of a second embodiment of an articulated support assembly according to the present invention.

Referring now to FIG. 14 there is shown a second embodiment of a keyboard support assembly according to the present invention generally designated by the reference numeral 210, in which parts similar to the parts of the keyboard support assembly 10 described above are identified with like reference numerals to which has been added the suffix "a". The keyboard support assembly 210 differs from the keyboard assembly 10 in that the platform 16*a* and space between the attachment members 11*a* is increased and a mouse pad support plate 212 is positioned between an upper surface 213 of the platform 16*a* on which the keyboard is adapted to be supported and one of the pairs 25 of mating polymeric moldings with an upper surface 214 of the mouse pad support plate 212 at about the same level as that upper surface 213. The wrist rest assembly 94*a* is also extended so that it can rest the wrists of the user as he or she uses either the keyboard or the mouse.

The present invention has now been described with reference to one embodiment and several modifications thereof. It will be apparent to those skilled in the art that many further modifications and changes can be made in the embodiment described without departing from the scope of the present invention. Thus the scope of the present invention should not be limited to the structures and modifications thereof described in this application, but only by structures described by the language of the claims and the equivalents of those structures.

We claim:

1. An articulated support assembly adapted for adjustably supporting a computer keyboard along one edge of a horizontal support member having a bottom surface, said support assembly comprising two attachment members adapted to be attached to the bottom surface of the horizontal support member in spaced relationship adjacent said edge;

a platform having an upper surface adapted to have a computer keyboard supported thereon;

a generally U shaped rigid support member having an elongate central portion having a central portion axis and having opposite axially spaced ends and generally parallel end portions projecting in the same direction from the opposite ends of said central portion;

platform mounting means mounting said platform on said central portion for pivotal movement of said platform about said central portion axis with said upper surface generally parallel to said central portion axis;

first releasable retaining means between said platform and said central portion moveable between a retaining position for restricting pivotal movement of said platform about said central portion axis, and a release position affording relatively free pivotal movement of said platform about said central portion axis;

support member mounting means adapted for mounting said end portions of said support member on said attachment members for pivotal movement about a pivot axis parallel to said central portion axis to afford revolving said central portion about said pivot axis; and second releasable retaining means between said end portions and said attachment members moveable between an engaged position for preventing revolving movement of said central portion toward a lowered position relative to said attachment members, and a disengaged position for affording revolving movement of said central portion toward either a lowered or a raised position relative to said attachment members.

2. An articulated support assembly according to claim 1 further including switching means adapted for manual actuation and moveable between a normal position positioning said second releasable retaining means in said engaged position and positioning said first releasable retaining means in said retaining position to afford supporting said platform at a predetermined position relative to said attachment members, and at least one adjustment position for positioning said second releasable retaining means in said disengaged position and said first releasable retaining means in said release position to afford adjusting the position and orientation of the platform relative to said attachment members.

3. An articulated support assembly according to claim 2 wherein said switching means adapted for manual actuation and moveable between said normal and adjustment positions comprises an elongate control bar having an axis and opposite ends, means on at least one of said ends adapted for manual engagement, means mounting said control bar on said platform with said control bar axis parallel to and spaced from said central portion axis for rotation about said control bar axis between said normal position and said adjustment position, and means for biasing said control bar toward said normal position.

4. An articulated support assembly according to claim 1 wherein said first releasable retaining means between said platform and said central portion comprises a plurality of pressure plates and friction discs having side surfaces, mounting means mounting said pressure plates and friction discs around said central portion with said side surfaces projecting radially with respect to the axis of said central portion and with each of said friction discs between two of said pressure plates, said mounting means affording relative movement of said friction discs and pressure plates axially along said central portion while preventing rotation of said friction discs relative to said central portion and mounting said pressure plates on said platform to prevent rotation of said pressure plates around said central portion relative to said platform, means for biasing the side surfaces of said pressure plates against the side surfaces of said friction discs, and clutch means moveable between an engaged position of said clutch means for allowing said means for biasing to press the side surfaces of said pressure plates against the side surfaces of said friction discs to cause friction therebetween to restrict relative rotation therebetween and fix the position of said platform with respect to said central portion, and a disengaged position of said clutch means separating said pressure plates in opposition to said means for biasing to afford relative rotation between said friction discs and said pressure plates to afford rotation of said platform with respect to said central portion.

5. An articulated support assembly according to claim 1 wherein said second releasable retaining means between said distal end parts and said attachment members that is moveable between said engaged position preventing revolving movement of said central portion toward a lowered position relative to said attachment members, and said disengaged position for affording revolving movement of said central portion toward either a lowered position or a raised position relative to said attachment members comprises a gear having an axis and spaced radially outwardly projecting gear teeth attached to each of said attachment members with the gears coaxial with said pivot axis, a pawl assembly, said pawl assembly including a pivot portion having a first end mounted on said support member mounting means for pivotal movement about a pivot portion axis parallel with said pivot axis, and a second end having an arcuate surface that is cylindrically concave about an axis parallel to said pivot axis and faces the teeth on said gear, and said pawl assembly further including a rocking portion having first and second sides, a cylindrically convex surface on said first side adapted to nest in the arcuate surface of said pivot portion and a plurality of teeth projecting along said second side adapted to engage between the teeth of said gear, said pivot and rocking portions being oriented with the axis of said arcuate surface below a straight line between said pivot axis and said pivot portion axis to cause said pivot portion to press said concave surface against the convex surface of said rocking portion and said teeth on said rocking portion into engagement with said teeth on said gear to prevent revolving movement of said central portion toward a lowered position relative to said attachment members, while causing upward movement of said support member relative to said attachment members to pivot said pivot portion and move said arcuate surface away from said gear to afford separation of said teeth on said rocking portion from said gear and afford revolving movement of said central portion toward a raised position relative to said attachment members.

6. An articulated support assembly according to claim 5 wherein said rocking portion has a guide surface defining a through slot generally at the axis of said cylindrically convex surface and a side surface defining a recess along the side of said rocking portion opposite said straight line between said pivot axis and said pivot portion axis, said pivot portion includes a pin projecting through said slot and adapted to engage said guide surface to carry said rocking portion on said pivot portion and provide a pivot axis for said rocking portion to pivot the teeth adjacent said recess out of engagement with the teeth on said gear around teeth on said rocking portion opposite said recess engaged with teeth on said gear when upward movement of said support member relative to said attachment members is initiated, and said support member mounting means has a pin adapted to be engaged by the surface defining said recess when the teeth adjacent said recess pivot out of engagement with said gear to restrict further pivoting of said teeth adjacent said recess away from said gear and cause opposite pivot motion of said rocking portion about said pins to cause the teeth opposite said recess to separate from said gear during further upward movement of said support member relative to said attachment members; and wherein said second releasable retaining means is moved to said disengaged position by pivoting said pivot portions relative to said end parts to move said arcuate surfaces away from said gears and cause engagement of said pins with said surfaces defining said slot and said recess to cause retraction of said teeth on said rocking portions to positions spaced from said teeth on said gears.

7. An articulated support assembly according to claim 1 further including a mouse pad support plate having a planar upper surface adapted to support a mouse pad, and means for mounting said mouse pad support plate on said platform with said planar upper surface of said mouse pad support plate generally parallel to the upper surface of said platform.

8. An articulated support assembly according to claim 7 wherein said means for mounting said mouse pad support plate includes means for adjusting the position of said mouse pad support plate with respect to said platform between positions with portions of said mouse pad support plate overlying portions of said platform to afford positioning a portion of a keyboard therebetween, and positions with said mouse support plate at one end of said platform.

9. An articulated support assembly according to claim 7 wherein said mouse pad support plate has an elongate part having first and second ends along the side of said mouse pad support plate normally opposite said attachment members; said articulated support assembly further includes a second elongate pad support portion supported on said elongate part of said mouse pad support plate and having an upper surface; and an elongate pad comprising a layer of solid gel supported on said upper surface, said pad having opposite top and bottom surfaces and a sufficient thickness between said top and bottom surfaces to afford supporting a users wrist on said top surface with a portion of the layer of solid gel beneath and conforming to the supported wrist and affording significant motion of the top surface of the pad with the supported wrist relative to the bottom surface in a horizontal plane.

10. An articulated support assembly according to claim 7 wherein said mouse pad support plate has a generally vertically disposed surface projecting above the planar upper surface of said mouse pad support plate along one side of said planar upper surface, and said articulated support assembly includes one portion of a releasable fastener means attached to said vertically disposed surface and adapted to be releasably engaged by a second portion of said releasable fastener means on a mouse to releasably retain the mouse along said vertically disposed surface and on a mouse pad along said planar upper surface of said mouse pad support plate.

11. An articulated support assembly according to claim 1 further including slip clutch means between said parallel end portions and said attachment members for affording revolving movement of said platform on said central portion toward a lowered position relative to said attachment members in response to application of a downward force to said platform above a predetermined minimum.

12. An articulated support assembly according to claim 1 further including one portion of a releasable fastener means attached to said upper surface of said platform and adapted to be releasably engaged by a second portion of said releasable fastener means on a keyboard to releasably retain the keyboard along said upper surface of said platform.

13. An articulated support assembly according to claim 1 further including a slide assembly attached to each of said attachment members, each of said slide assemblies comprising an elongate traveling portion disposed at a right angle to said pivot axis and fixed to one of said attachment members, and a second elongate rail portion adapted to be attached to the bottom surface of the horizontal support member with one end at the edge of the support member, parts of said traveling portions being received in and slideable along the elongate rail portions to afford movement of said platform between positions projecting beyond the edge of the support member and positions along the bottom surface of the support member.

14. An articulated support assembly according to claim 1 wherein said platform has an elongate part having first and second ends along the side of said upper surface normally opposite said attachment members; said articulated support assembly further includes an elongate pad support portion supported on said elongate part and having first and second ends and an upper surface; and an elongate pad comprising a layer of solid gel supported on said upper surface, said pad having opposite top and bottom surfaces and a sufficient thickness between said top and bottom surfaces to afford supporting a user's wrists on said top surface with a portion of the layer of solid gel beneath and conforming to the supported wrists and to afford significant motion of the top surface of the pad with the supported wrists relative to the bottom surface and in a horizontal plane;

said pad support portion and said elongate part of said platform having engaging parts adapted for engagement in a first relative orientation with said first ends of said pad support portion and said elongate part of said platform adjacent, said second ends of said pad support portion and said elongate part of said platform adjacent, and with the top surface of said elongate pad supported at a first predetermined level with respect to said platform, and adapted for engagement in a second relative orientation with said first end of said pad support portion adjacent the second end of said elongate part of the platform, with said second end of said pad support portion adjacent the first end of said elongate part of the platform, and with the top surface of said elongate pad supported at a second predetermined level with respect to said platform.

15. An articulated support assembly according to claim 14 wherein in said first relative orientation the top surface of the pad is about 1 inch above the upper surface of the platform, and in said second relative orientation the top surface of the pad is about 1.4 inches above the upper surface of the platform.

* * * * *